US005615705A

United States Patent [19]

Cho

[11] Patent Number: 5,615,705

[45] Date of Patent: Apr. 1, 1997

[54] CONTROL VALVE FOR HEAVY CONSTRUCTION EQUIPMENT HAVING REGENERATION FUNCTION

[75] Inventor: Hyung J. Cho, Changwon, Rep. of Korea

[73] Assignee: Samsung Heavy Industries Co., Inc., Seoul, Rep. of Korea

[21] Appl. No.: 497,125

[22] Filed: Jun. 30, 1995

[30] Foreign Application Priority Data

Oct. 5, 1994 [KR] Rep. of Korea ..... 94-25400

[51] Int. Cl.[6] ..... F15B 13/04

[52] U.S. Cl. ..... 137/596.2; 91/420; 91/436; 137/625.68

[58] Field of Search ..... 91/420, 436; 137/596.2, 137/625.68

[56] References Cited

U.S. PATENT DOCUMENTS 4,388,946 6/1983 Richter et al. ..... 137/625.68 X

*Primary Examiner*—Gerald A. Michalsky

[57] ABSTRACT

A control valve having a regeneration function, including a hollow valve body, a plurality of spaced ports provided at the valve body, the ports including a pump port, an actuator port, a regeneration port and a tank port, a hollow main spool movably disposed in the valve body, a regeneration spool movably disposed in the main spool and adapted to be moved by a flow of fluid delivered from a pump through the pump port, a fluid passage provided at the main spool and adapted to communicate the actuator port and the tank port together, the fluid passage being opened or closed by the movement of the regeneration spool, whereby as the regeneration spool is moved by the fluid flow delivered from the pump, a part, to be fed to the tank port, of a flow of fluid emerging from the actuator port is increased, while a part to be fed to the regeneration port is correspondingly decreased.

16 Claims, 2 Drawing Sheets

CONTROL VALVE FOR HEAVY CONSTRUCTION EQUIPMENT HAVING REGENERATION FUNCTION

BACKGROUND OF THE INVENTION

1. Field of the Invention

The present invention relates to a control valve for heavy construction equipment having a regeneration function.

2. Description of the Prior Art

"Regeneration" is to return a flow of fluid generated at return-side of an actuator to a supply-side of the actuator as a supplementary fluid in order to prevent a generation of a cavitation due to a shortage of fluid at the supply-side of the actuator and thereby achieving smoother operation.

Such a regeneration should be achieved utilizing the weight of an actuator associated with the regeneration, not a supply of fluid to the actuator obtained by a separate pumping means. For example, in an excavator, regeneration is to use a return flow of highly pressurized fluid, obtained upon lowering a boom by the weight of the boom, for raising the boom.

A typical conventional construction for achieving such a regeneration is illustrated in FIGS. 1 and 2. By referring to FIGS. 1 and 2, a control valve 100 is shown as having a main spool 101 in which a regeneration spool 103 is disposed to be resiliently biased at a predetermined pressure by a pressure setting spring 102. As the regeneration spool 103 moves, switching of fluid passages provided in the control valve 100 between opened and closed states is carried out to achieve regeneration. This will be described in more detail. As the main spool 101 moves in the direction indicated by arrow A in FIG. 1, a fluid passage 104 is opened to allow the interior of the main spool 101 to communicate with an actuator port C. A pressure generated by the return flow of fluid through the actuator port C serves to push the regeneration spool 103 in the direction indicated by arrow B in FIG. 1. As a result, a part of the return fluid flow discharged out of the actuator port C returns toward a tank T via a fluid passage 105. Meanwhile, the other part of the return fluid flows toward a pump P through a fluid passage 106 so that it is regenerated at the side of another actuator port opposite to the actuator port C, that is, the supply-side of the actuator.

However, such a conventional regeneration construction has a disadvantage of the impossibility to appropriately adjust the amount of fluid to be regenerated when an adjustment is required. This is because each of the fluid passages 104, 105 and 106 has only two switched states, namely, an opened state and a closed state. Here, the requirement to adjust the amount of fluid to be regenerated generally depends on the amount of fluid delivered from the pump. In other words, where the fluid amount delivered from the pump is sufficient, it is unnecessary to provide regeneration. If regeneration is obtained in this case, a flow of fluid delivered from the pump flows backward along the opened regeneration fluid line (the fluid passage 106 in the case of FIGS. 1 and 2) to the return-side of the actuator (the actuator port C in the case of FIGS. 1 and 2). This results in a loss of pressure at the supply-side of the actuator. On the other hand where the fluid amount delivered from the pump is insufficient, it is necessary to increase the amount of fluid to be regenerated in order to supplement the shortage of the fluid amount delivered from the pump.

SUMMARY OF THE INVENTION

Therefore, an object of the invention is to provide a control valve for heavy construction equipment, capable of appropriately adjusting the amount of fluid to be regenerated depending on the fluid amount delivered from the pump, thereby preventing a loss of pressure and achieving a more accurate and effective regeneration function.

In accordance with the present invention, this object is accomplished by providing a control valve having a regeneration function, comprising: a hollow valve body: a plurality of spaced ports provided at the valve body, the ports including a pump port, an actuator port, a regeneration port and a tank port; a hollow main spool movably disposed in the valve body; a regeneration spool movably disposed in the main spool and adapted to be moved by a flow of fluid delivered :from a pump through the pump port; a fluid passage provided at the main spool and adapted to communicate the actuator port and the tank port together, the fluid passage being opened or closed by the movement of the regeneration spool, whereby as the regeneration spool is moved by the fluid flow delivered from the pump, a part to be fed to the tank port, of a flow of fluid emerging from the actuator port is increased, while the part to be fed to the regeneration port Is correspondingly decreased.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
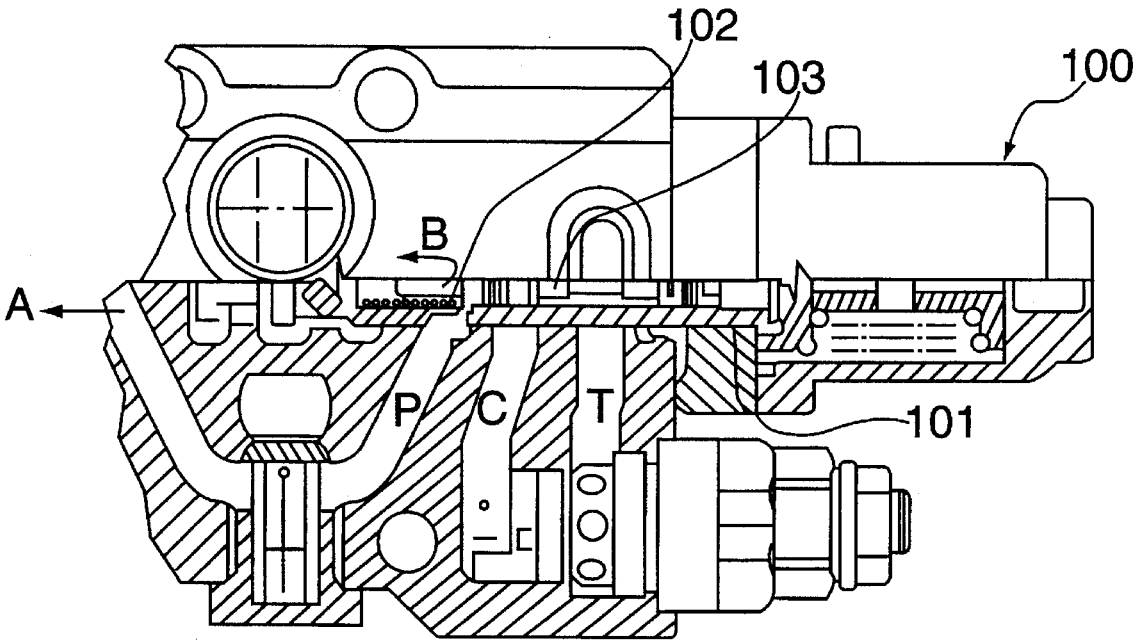
FIG. 1 PRIOR ART
FIG. 1 is a sectional view of an essential part of a control valve, showing a conventional regeneration construction.
Figure 2:
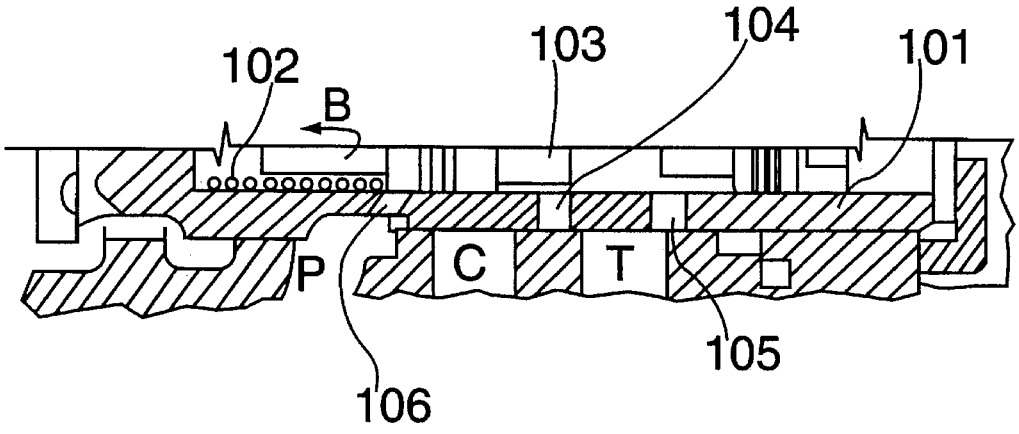
FIG. 2 PRIOR ART
FIG. 2 is a sectional view of a detailed construction of the control valve shown in FIG. 1.
Figure 3:
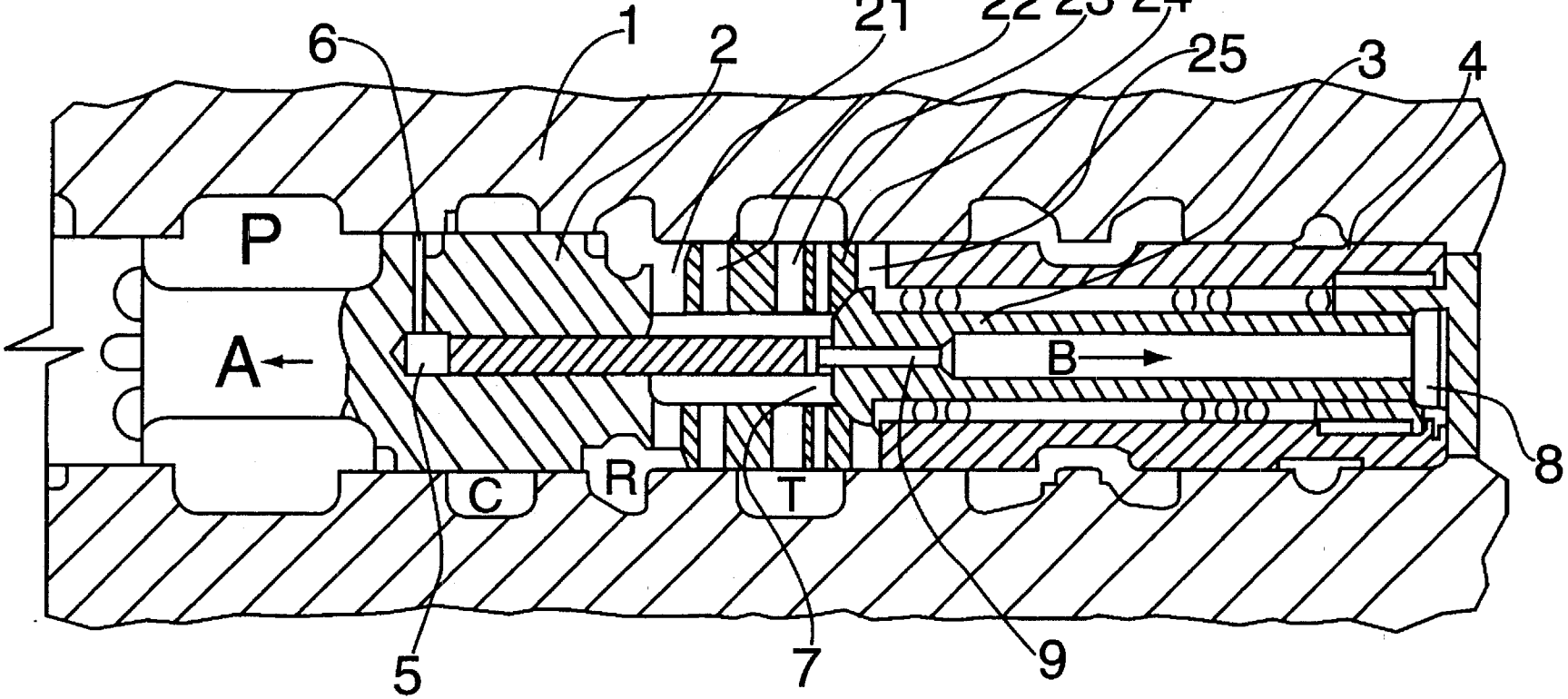
FIG. 3 is a sectional view of a control valve having a regeneration function in accordance with an embodiment of the present invention.

Referring to FIG. 3, there is illustrated a control valve for heavy construction equipment having a regeneration function in accordance with an embodiment of the present invention.

As shown in FIG. 3, the control valve includes a hollow valve body 1 and a hollow main spool 2 disposed in the interior of the valve body 1 such that it can move laterally, when viewed in the drawing, within a predetermined stroke. The valve body 1 is provided with a plurality of spaced ports including a pump port P, an actuator port C, a regeneration port R and a return port T. The main spool 2 is provided with a plurality of spaced fluid passages 6, 21, 22, 23, 24 and 25 each associated with its selected port of the valve body 1. As the main spool 2 moves, the ports P, C, R and T are allowed to communicate with their associated fluid passages 6, 21, 22, 23, 24 and 25 or are prevented from communicating therewith. As the main spool 2 moves in the direction indicated by arrow A in FIG. 3, the fluid passage 6 communicates with the pump port P, the fluid passage 21 communicates with the actuator port C, the fluid passage 22 communicates with the regeneration port R, and the fluid passages 23 and 24 communicate with the tank port T. The fluid passage 25 will be described hereinafter.

A regeneration spool 3 is disposed in a hollow portion of the main spool 2 such that it can move laterally, when viewed in FIG. 3, within a predetermined stroke. The regeneration spool 3 is resiliently biased at one end by a predetermined pressure generated from a pressure setting spring 4. The other end of the regeneration spool 3 is sealably received in a hydraulic chamber 5 defined at one side of the hollow portion of the main spool 2. When the main spool 2 moves in direction A, the hydraulic chamber 5 communicates with the pump port P through the fluid passage 6. As the hydraulic chamber 5 communicates with the pump port P, a flow of fluid delivered from a pump (not shown) is introduced in the hydraulic chamber 5 through the pump port P, thereby causing the regeneration spool 3 to move in the direction indicated by arrow B in FIG. 3 against the resilience of the pressure setting spring 4. On the other hand, the fluid passages 23, 24 and 25 are adapted to communicate with the tank port T. The fluid passages 23 and 24 are opened only when no movement of the regeneration spool 3 occurs. As the regeneration spool 3 moves in direction B, the fluid passage 25 is opened. The opened degree or area of the fluid passage 25 is varied in proportion to the distance moved by regeneration spool 3.

As the hydraulic chamber 5 communicates with the pump port P through the fluid passage 6 by virtue of the movement of the main spool 2 in direction A, the flow of fluid delivered from the pump and then introduced in the hydraulic chamber 5 acts to push the regeneration spool 3 in direction B. When the pressure of the fluid flow does not exceed the predetermined pressure generated by the pressure setting spring 4 because of an insufficient fluid amount delivered from the pump at this time, the regeneration spool 3 cannot move in direction B at all. In this case, the fluid flow from the return-side actuator port C flows along the fluid passage 21 and then partially enters the regeneration port R via the fluid passage 22 so that it is supplied to a supply-side actuator port opposite to the actuator port C. The remaining part of the fluid flow enters the tank port T via the fluid passages 23 and 24 so that it returns to a tank (not shown).

Where the fluid amount delivered from the pump is sufficient, the regeneration spool 3 is forced to move in direction B, thereby causing even the fluid passage 25 to be opened. The opened area of the fluid passage 25 is proportional to the moved distance of the regeneration spool 3 proportional to the fluid amount delivered from the pump. Accordingly, an increased fluid amount delivered from the pump results in an increase in the return amount of fluid flowing toward the tank port T and a decrease in the regeneration amount of fluid passing through the regeneration port R.

Of the flow of fluid emerging from the return-side actuator port C, the part to be returned through the tank port T, therefore, becomes smaller at a smaller fluid amount delivered the pump. Correspondingly to the smaller return part, the part to be supplied, for regeneration, to the supply-side of the actuator through the regeneration port R becomes larger. On the contrary, at a larger fluid amount delivered from the pump, the flow of fluid from the return-side actuator port C involves a larger return part and a smaller regeneration part because the opened area of the fluid passage 25 returning the fluid to the tank is increased. Thus, the amount of fluid to be regenerated can be appropriately adjusted on the basis of the fluid amount delivered from the pump.

Preferably, the regeneration spool 3 has a pressure receiving portion 7 for receiving a spool moving pressure resulted from a flow of fluid emerging from the actuator port C, a back pressure-side portion 8 disposed opposite to the pressure receiving portion 8 and having the same area as the pressure receiving portion 7, and a communication fluid passage 9 extending throughout the regeneration spool 3 to communicate the pressure receiving portion 7 and the back pressure-side portion 8 together. Through the communication fluid passage 9, the pressure receiving portion 7 and the back pressure-side portion 8 are kept under a balanced pressure. As a result, the flow of fluid emerging from the actuator port C cannot have any effect on the movement of the regeneration spool 3 at all. Consequently, the movement of the regeneration spool 3 is dependent only on the relation between the pressure resulted from the fluid flow delivered from the pump and the predetermined pressure of the pressure setting spring 4. Since the predetermined pressure of the pressure setting spring 4 is a constant, the moved distance of the regeneration spool 3 is determined depending only on the fluid amount delivered from the pump.

In accordance with the illustrated embodiment of the present invention, the moved distance of the regeneration spool is increased as the fluid amount delivered from the pump is increased. The increase in the moved distance of the regeneration spool results in an increase in the opened area of the fluid passage communicating with the tank port. Of the flow of fluid emerging from the return-side actuator port C, the return part, therefore, is increased, while the regeneration part is decreased. Thus, it is possible to appropriately adjust the amount of fluid to be regenerated depending on the fluid amount delivered from the pump.

As apparent from the above description, the present invention provides a control valve for heavy construction equipment, capable of appropriately adjusting the amount of fluid to be regenerated depending on the fluid amount delivered from the pump, thereby preventing a loss of pressure and achieving a more accurate and effective regeneration function.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A control valve having a regeneration function, comprising:

a hollow valve body;

a plurality of spaced ports provided at the valve body, the ports including a pump port, an actuator port, a regeneration port and a tank port;

a hollow main spool movably disposed in the valve body;

a regeneration spool movably disposed in the main spool, said regeneration spool being movable by a flow of fluid delivered from a pump through the pump;

a fluid passage provided at the main spool and adapted to communicate the actuator port and the tank port together, the fluid passage being opened or closed by the movement of the regeneration spool, with means for increasing a part, to be fed to the tank port, of a flow of fluid emerging from the actuator port and correspondingly decreasing a part to be fed to the regeneration port as the regeneration spool is moved by the fluid flow delivered by the pump.

2. The control valve in accordance with claim 1, wherein the moved distance of the regeneration spool is proportional to the amount of the fluid flow delivered from the pump.

3. The control valve in accordance with claim 2, wherein the fluid passage has an opened area proportional to the moved distance of the regeneration spool.

4. The control valve in accordance with claim 3, further comprising:

resilience means adapted to resiliently bias the regeneration spool at a predetermined pressure in the main spool.

5. The control valve in accordance with claim 4, wherein the movement of the regeneration spool is carried out against a resilience of the resilience means by a pressure of the fluid flow delivered from the pump.

6. The control valve in accordance with claim 3, further comprising:

a pressure receiving portion provided at the regeneration spool and adapted to receive a spool moving pressure from the fluid flow emerging from the actuator port;

a back pressure-side portion prodded at the regeneration spool in opposite to the pressure receiving portion, the back pressure-side portion having the same area as the pressure receiving portion; and a communication fluid passage provided at the regeneration spool and adapted to communicate the pressure receiving portion and the back pressure-side portion together and thereby provide a pressure balance between the pressure receiving portion and the back pressure-side portion.

7. The control valve in accordance with claim 2, further comprising:

resilience means adapted to resiliently bias the regeneration spool at a predetermined pressure in the main spool.

8. The control valve in accordance with claim 7, wherein the movement of the regeneration spool is carried out against a resilience of the resilience means by a pressure of the fluid flow delivered from the pump.

9. The control valve in accordance with claim 2, further comprising:

a pressure receiving portion provided at the regeneration spool and adapted to receive a spool moving pressure from the fluid flow emerging from the actuator port;

a back pressure-side portion prodded at the regeneration spool opposite to the pressure receiving portion, the back pressure-side portion having the same area as the pressure receiving portion; and a communication fluid passage provided at the regeneration spool and adapted to communicate the pressure receiving portion and with back pressure-side portion thereby providing a pressure balance between the pressure receiving portion and the back pressure-side portion.

10. The control valve in accordance with claim 1, wherein the fluid passage has an opened area proportional to the moved distance of the regeneration spool.

11. The control valve in accordance with claim 10, further comprising:

resilience means adapted to resiliently bias the regeneration spool at a predetermined pressure in the main spool.

12. The control valve in accordance with claim 11, wherein the movement of the regeneration spool is carried out against a resilience of the resilience means by a pressure of the fluid flow delivered from the pump.

13. The control valve in accordance with claim 10, further comprising:

a pressure receiving portion provided at the regeneration spool and adapted to receive a spool moving pressure from the fluid flow emerging from the actuator poet;

a back pressure-side portion provided at the regeneration spool in opposite to the pressure receiving portion, the back pressure-side portion having the same area as the pressure receiving portion; and a communication fluid passage provided at the regeneration spool and adapted to communicate the pressure receiving portion and the back pressure-side portion together and thereby provide a pressure balance between the pressure receiving portion and the back pressure-side portion.

14. The control valve in accordance with claim 1, further comprising:

resilience means adapted to resiliently bias the regeneration spool at a predetermined pressure in the main spool.

15. The control valve in accordance with claim 14, wherein the movement of the regeneration spool is carried out against a resilience of the resilience means by a pressure of the fluid flow delivered from the pump.

16. The control valve in accordance with claim 1, further comprising:

a pressure receiving portion provided at the regeneration spool and adapted to receive a spool moving pressure from the fluid flow emerging from the actuator port;

a back pressure-side portion prodded at the regeneration spool opposite to the pressure receiving portion, the back pressure-side portion having the same area as the pressure receiving portion; and a communication fluid passage provided at the regeneration spool and adapted to communicate the pressure receiving portion with the back pressure-side portion thereby providing a pressure balance between the pressure receiving portion and the back pressure-side portion.

* * * * *